US008166754B2

(12) United States Patent
Frantzheld et al.

(10) Patent No.: US 8,166,754 B2
(45) Date of Patent: May 1, 2012

(54) EXHAUST MANIFOLD

(75) Inventors: Gerolf Frantzheld, Aichwald (DE); Jürgen Orlich, Herrenberg (DE); Andreas Ruess, Stuttgart (DE)

(73) Assignee: Daimler AG, Stuttgart (DE)

( * ) Notice: Subject to any disclaimer, the term of this patent is extended or adjusted under 35 U.S.C. 154(b) by 795 days.

(21) Appl. No.: 12/317,280

(22) Filed: Dec. 19, 2008

(65) Prior Publication Data

US 2009/0139229 A1 Jun. 4, 2009

Related U.S. Application Data

(63) Continuation-in-part of application No. PCT/EP2007/005220, filed on Jun. 13, 2007.

(30) Foreign Application Priority Data

Jun. 21, 2006 (DE) ..... 10 2006 030 748

(51) Int. Cl.

| | |
|---|---|
| ***F02D 23/00*** | (2006.01) |
| ***F02B 33/44*** | (2006.01) |
| ***F02B 37/22*** | (2006.01) |
| ***F02B 37/12*** | (2006.01) |
| ***F01N 7/10*** | (2006.01) |
| ***F01D 1/02*** | (2006.01) |
| ***F01D 9/00*** | (2006.01) |
| ***F04D 29/44*** | (2006.01) |
| ***F04D 29/54*** | (2006.01) |

(52) U.S. Cl. ..... 60/602; 60/605.2; 60/323; 415/205

(58) Field of Classification Search ..... 60/602, 60/605.2; 123/562; 415/204–205, 223; 251/129.11, 251/58; 137/527.8, 625.46, 875
See application file for complete search history.

(56) References Cited

U.S. PATENT DOCUMENTS

| | | | | |
|---|---|---|---|---|
| 1,850,405 | A * | 3/1932 | Lothrop | 477/188 |
| 3,557,549 | A * | 1/1971 | Webster | 60/602 |
| 3,559,397 | A * | 2/1971 | Navaro | 60/602 |
| 3,591,959 | A * | 7/1971 | Kubis | 415/205 |
| 4,294,073 | A * | 10/1981 | Neff | 415/205 |
| 4,339,922 | A * | 7/1982 | Navarro | 60/602 |
| 4,353,390 | A * | 10/1982 | Karpenko | 137/527.8 |
| 4,395,884 | A | 8/1983 | Price | 60/602 |
| 4,544,326 | A * | 10/1985 | Nishiguchi et al. | 60/602 |
| 4,556,192 | A * | 12/1985 | Ramisch | 251/58 |
| 5,079,921 | A * | 1/1992 | McCandless et al. | 60/602 |
| 5,911,243 | A * | 6/1999 | Cohen | 137/625.46 |
| 6,135,415 | A * | 10/2000 | Kloda et al. | 251/129.11 |
| 6,216,737 | B1 * | 4/2001 | Taylor et al. | 137/875 |
| 6,295,815 | B1 * | 10/2001 | Bechle et al. | 60/605.2 |
| 6,543,228 | B2 * | 4/2003 | Deacon | 60/602 |

(Continued)

FOREIGN PATENT DOCUMENTS

| | | |
|---|---|---|
| DE | 2 012 957 | 10/1970 |

(Continued)

*Primary Examiner* — Thai Ba Trieu
(74) *Attorney, Agent, or Firm* — Klaus J. Bach

(57) ABSTRACT

In an exhaust manifold for an internal combustion engine including a central part with tow exhaust gas flow ducts extending from the central part in opposite directions for collecting exhaust gas from first and respectively second cylinder groups of the engine, the center part includes a first control valve for controlling the exhaust gas flow from the first and the second cylinder groups to first and second turbine inlet flow passages, a second control valve for controlling the exhaust gas pressure and a third control valve for controlling the exhaust gas recirculation rate.

11 Claims, 8 Drawing Sheets

U.S. PATENT DOCUMENTS

| | | | | |
|---|---|---|---|---|
| 6,883,320 | B2 * | 4/2005 | Tyler | 60/602 |
| 2011/0131978 | A1 * | 6/2011 | Okada | 60/602 |

FOREIGN PATENT DOCUMENTS

| | | | |
|---|---|---|---|
| DE | 30 08 180 | | 9/1981 |
| DE | 103 57 925 | | 7/2005 |
| DE | 10357925 | A1 * | 7/2005 |
| GB | 937 943 | | 6/1962 |
| JP | 02 161162 | | 6/1990 |
| JP | 2004068631 | A * | 3/2004 |
| JP | 2004124749 | A * | 4/2004 |

* cited by examiner

EXHAUST MANIFOLD

This is a Continuation-In-Part application of pending international patent application PCT/EP2007/005220 filed Jun. 13, 2007 and claiming the priority of German patent application 10 2006 030 748.8 filed Jun. 21, 2006.

BACKGROUND OF THE INVENTION

The invention relates to an exhaust manifold for an internal combustion engine comprising a central part that has two exhaust gas flow ducts, exhaust gas from a first cylinder group of the internal combustion engine being delivered to a first exhaust gas flow duct of the central part and exhaust gas from a second cylinder group of the internal combustion engine being delivered to a second exhaust gas flow duct of the central part, the first exhaust gas flow duct being connected to a first turbine flow passage and the second exhaust gas flow duct being connected to a second turbine flow passage.

DE 103 57 925 A1 discloses an internal combustion engine having an exhaust gas system, which comprises a first exhaust gas flow duct referred to as first exhaust line and a second exhaust gas flow duct referred to as second exhaust line. The internal combustion engine further comprises an exhaust-driven turbo-charger having a turbine and a compressor, the turbine having two flow passages of different size. Exhaust gas from a first cylinder group of the internal combustion can be delivered to a first flow passage of the turbine via the first exhaust gas flow duct and exhaust gas from a second cylinder group of the internal combustion can be delivered to a second flow passage of the turbine via the second exhaust gas flow duct. The two exhaust gas flow ducts, which lead from the two cylinder groups each to a flow passage of the turbine of the exhaust-driven turbocharger, are connected to one another via a connecting line, a control element being assigned to the connecting line for regulating an exhaust gas flow through the connecting line. A further control element serving to close the exhaust gas flow duct leading to the larger flow passage of the turbine of the exhaust-driven turbocharger is furthermore assigned to this exhaust gas flow duct. Branching off from the exhaust gas flow duct leading to the smaller flow passage of the turbine of the exhaust-driven turbocharger is an exhaust gas recirculation line, into which a further control element is incorporated, which serves to control or regulate the magnitude of an exhaust gas recirculation flow. The control elements are separate sub-assemblies and are arranged in separate lines. This takes up a lot of space overall.

It is the object of the present invention to provide a new type of exhaust manifold, which accomplishes an exhaust gas flow control with relatively small space requirements.

SUMMARY OF THE INVENTION

In an exhaust manifold for an internal combustion engine including a central part with two exhaust gas flow ducts extending aligned from the central part in opposite directions for collecting exhaust gas from first and respectively second cylinder groups of the engine, the central part includes a first control valve for controlling the exhaust gas flow from the first and the second cylinder groups to first and second turbine inlet flow passages, a second control valve for controlling the exhaust gas pressure and a third control valve for controlling the exhaust gas recirculation rate.

The central part of the exhaust manifold is, in particular, embodied as a separate component and is bolted, welded or otherwise connected to adjoining outer parts of the exhaust manifold. It is equally possible for the central part of the exhaust manifold to be integrally formed with one or more outer parts of the exhaust manifold. Since the control elements are all incorporated into the central part of the exhaust manifold, an extremely compact design of a unit comprising the exhaust manifold and the required control elements is obtained.

In a particular embodiment of the invention also a control element for influencing the engine brake function is incorporated into a wall of the central part, which separates the two exhaust gas flow ducts which are aligned with one another. This further reduces the overall space requirements.

Preferably, the control element for influencing the engine brake function is embodied as a flap valve, which in a first switching position, particularly whilst the internal combustion engine is firing, closes an opening in the wall of the central part, thereby separating the two exhaust gas flow ducts from one another. In a second switching position, particularly during an engine braking mode of the internal combustion engine, the flap valve is opened thereby providing an opening in the wall of the central part, and interconnecting the two exhaust gas flow ducts. At the same time, one of the two exhaust gas flow ducts is at least partially closed. This makes it possible, in particular, to control the cross-flow between the individual exhaust gas flow ducts and a flow through at least one turbine flow passage as a function of an engine operating state.

Preferably, the flap valve has two effective areas of different size. In a first switching position this makes it possible, in particular, to compensate for a pressure differential between the two exhaust gas flow ducts.

The control element for influencing the engine brake function is in particular eccentrically supported on an operating shaft, an operating means acting on the operating shaft in order to operate the control element extending alongside the flow ducts. This provides for a space-saving arrangement of the control element for influencing the engine brake function in the central part.

A spring element, which is braced against an outer wall of the central part and which draws the operating shaft towards a support bearing, acts on the operating shaft. The operating shaft preferably extends through a shaft passage to an outside of the central part. This embodiment represents a simple way of sealing the exhaust gas flow duct in the area around the shaft.

In a particular embodiment of the invention the control element for influencing the exhaust gas pressure is arranged upstream of the control element for influencing the engine brake function and is incorporated into a wall of the central part providing for a compact construction of the central part.

Preferably, the control element for influencing the exhaust gas pressure is embodied as a valve, which in a first switching position separates the two exhaust gas flow ducts from one another, which in a second switching position connects the two exhaust gas flow ducts together and which in both switching positions opens both exhaust gas flow ducts. This makes it possible, in particular, to adjust a cross flow between the individual exhaust gas flow ducts whilst maintaining a largely unimpeded flow through the turbine flow passages connected to the exhaust gas flow ducts.

In a further development of the invention the control element for influencing the exhaust gas pressure is supported on an operating shaft, an operating means acting on the operating shaft in order to operate the control element. This affords an especially compact construction of the central part.

A spring element, which is braced against an outer wall of the central part and which draws the operating shaft towards a support bearing, acts on the operating shaft. In particular, to seal off the exhaust gas flow ducts externally in the area of a shaft passage.

Advantageously, the control element for influencing the exhaust gas recirculation rate is incorporated into an exhaust gas recirculation connection of the central part. An exhaust gas recirculation line, via which an exhaust gas flow can be returned to an intake system of the internal combustion engine, is preferably connected to the exhaust gas recirculation connection.

The control element for influencing the exhaust gas recirculation rate is preferably a flap valve, the position of which serves to adjust a volumetric flow of the recirculated exhaust gas through the exhaust gas recirculation connection.

The control element for influencing the exhaust gas recirculation rate is supported on an operating shaft, an operating means acting on the operating shaft in order to operate the control element. This affords an especially space-saving arrangement of the control element for influencing the exhaust gas recirculation rate in the central part.

Advantageously, a spring element, which is braced against an outer wall of the central part and which draws the operating shaft towards a support bearing, acts on the operating shaft. This makes it possible, in particular, to externally seal off the inside of the exhaust gas recirculation connection in the area of a shaft passage.

The invention will become more readily apparent from more readily apparent from the following description of exemplary embodiments of the invention described below in more detail with reference to the accompanying drawings:

DESCRIPTION OF PARTICULAR EMBODIMENTS

Figure 1:
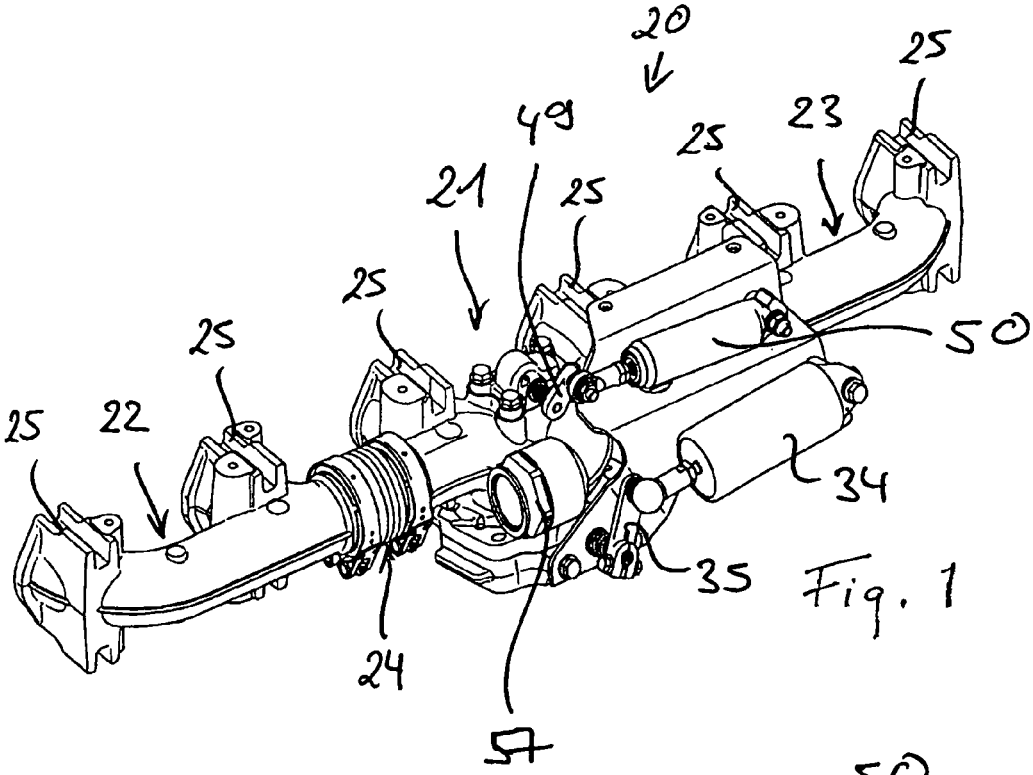
FIG. 1. shows a perspective view of a first exemplary embodiment of an exhaust manifold according to the invention.
Figure 2:
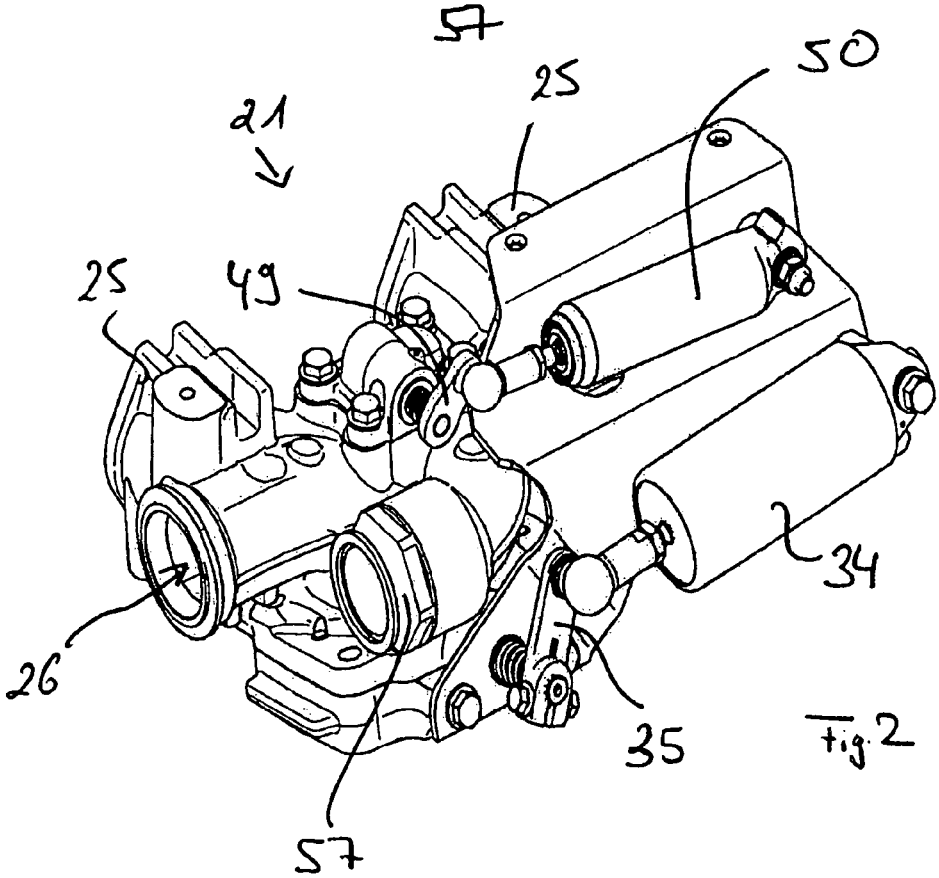
FIG. 2. shows a perspective view of a central part of the exhaust manifold according to FIG. 1.

FIG. 1 shows a first exemplary embodiment of an exhaust manifold 20 according to the invention. The exhaust manifold 20 is intended for use in an internal combustion engine of a motor vehicle. FIGS. 2 to 7 show details of the exhaust manifold 20 in FIG. 1.

The exhaust manifold 20 in FIG. 1 comprises a central part 21 and two outer parts 22, 23, the two outer parts 22 and 23 being connected to the central part 21, each by way of a bellows-like intermediate piece 24.

The exhaust manifold 20 in FIG. 1 is designed for an internal combustion engine having six cylinders arranged in-line. The two outer parts 22, 23 and the central part 21 each comprise two connection branches 25 for attaching the exhaust manifold 20 to the internal combustion engine. Exhaust gas from the internal combustion engine can be discharged into the exhaust manifold 20 via the connection branches 25. The two connection branches 25 of the outer part 22 and a first connection branch 25 of the central part 21 are assigned to a first cylinder group of the internal combustion engine, the exhaust gas produced in the first cylinder group being delivered to a first exhaust gas flow duct 26 of the central part 21 (see FIG. 3) of the exhaust manifold 20. The two connection branches 25 of the outer part 23 and the other connection branch 25 of the central part 21 are assigned to a second cylinder group of the internal combustion engine, the exhaust gas produced in the second cylinder group being delivered to a second exhaust gas flow duct 27 of the central part 21 (see FIG. 3) of the exhaust manifold 20. The two exhaust gas flow ducts 26, 27 of the central part 21 are each of curved design, the exhaust gas of the first exhaust gas flow duct 26 being delivered to a first inlet flow passage of a turbine of an exhaust-driven turbocharger, and the exhaust gas of the second exhaust gas flow duct 27 being delivered to a second inlet flow passage of the turbine of the exhaust-driven turbocharger.

The exhaust manifold 20, or more precisely the central part 21 thereof, is designed for coupling to an exhaust-driven turbocharger, the turbine of which comprises two flow passages, the flow passages being of different size. In the exemplary embodiment described here the first exhaust gas flow duct 26 of the central part 21 is connected to the larger flow passage of the turbine of the exhaust-driven turbocharger, and the second exhaust gas flow duct 27 of the central part 21 is connected to the smaller flow passage of the turbine of the exhaust-driven turbocharger.

The two exhaust gas flow ducts 26, 27 of the central part 21 have a curved contour. A direction of flow of the exhaust gas through the exhaust gas flow ducts 26, 27 is indicated by arrows 28 in FIG. 3. The exhaust gas directed through the exhaust gas flow ducts 26, 27 is deflected by approximately 90° and is introduced into sections of the curved exhaust gas flow ducts 26, 27, which are arranged approximately parallel to one another and are separated from one another by a wall 29.

Figure 3:
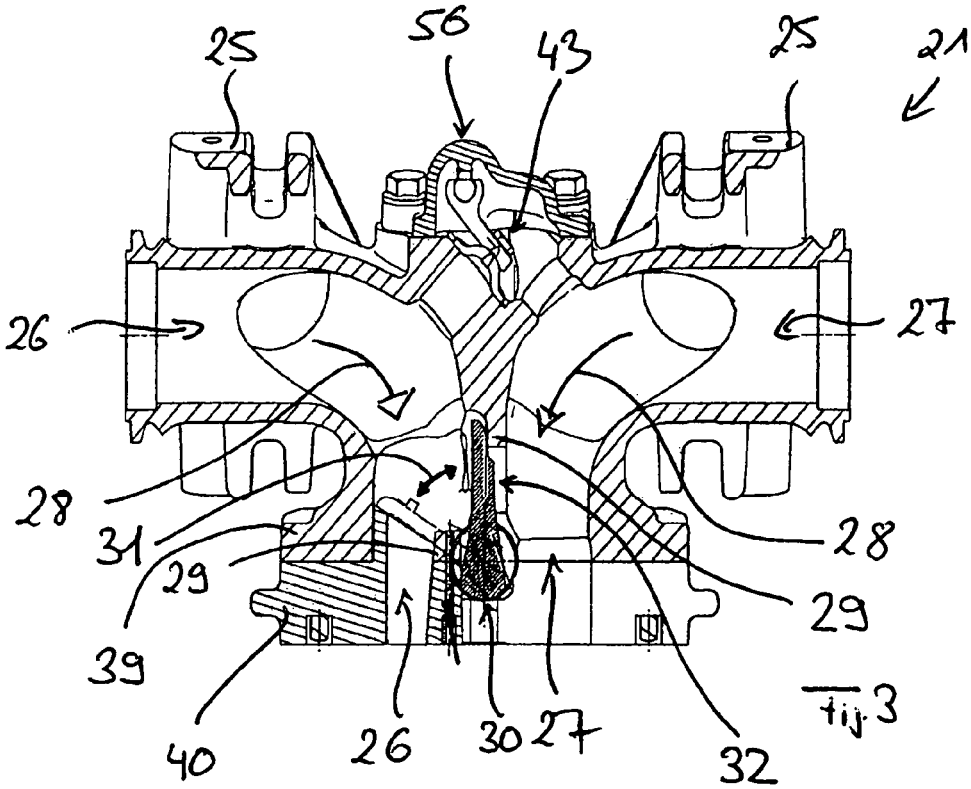
FIG. 3. shows a first cross section through the central part viewed in the direction of the arrows III-III according to FIG. 2.

According to a first aspect of the present invention a control element 30 for influencing an engine brake function is incorporated into the central part 21 of the exhaust manifold 20 according to the invention, that is into the wall 29 of the central part 21, which separates the two sections of the curved exhaust gas flow ducts 26, 27 arranged parallel to one another. In the exemplary embodiment described here this control element 30 is embodied as a flap valve. In FIG. 3 the flap valve is shown in a first switching position and also in a second switching position. In a preferred embodiment the flap valve can be shifted between the two switching positions in the direction of the double arrow 31 and can also assume intermediate positions between the first and the second switching positions.

In the first switching position of the control element 30 (represented by hatching in FIG. 3) the control element 30 closes an opening 32 in the wall 29, thereby separating the two exhaust gas flow ducts 26, 27 from one another. At the same time the control element 30 opens both exhaust gas flow ducts 26 and 27 to allow a through-flow. The control element 30 is located in the first switching position particularly during power operation of the internal combustion engine.

In a second switching position of the control element 30 (represented by dashed lines in FIG. 3) the control element 30 opens the opening 32 in the wall 29, thereby connecting the two exhaust gas flow ducts 26, 27 to one another. At the same time the control element 30 closes the exhaust gas flow duct 26, which leads to the large flow passage of the turbine of the exhaust-driven turbocharger. The control element 30 is located in the second switching position particularly during an engine braking mode of the internal combustion engine. In this way, in the engine braking mode of the internal combustion engine all the exhaust gas can be delivered to the small flow passage of the turbine of the exhaust-driven turbocharger.

As can best be seen from FIG. 3, the control element 30 embodied as a flap valve has two effective areas of different size. This makes it possible, particularly in the first switching position, to compensate for a pressure differential between the two exhaust gas flow ducts 26, 27. The larger effective area of the control element 30 here preferably faces the exhaust gas flow duct 26, 27, in which a lower pressure prevails over wide operating ranges. In the first switching position of the control element 30, represented by hatching in FIG. 3, a lower pressure prevails in the exhaust gas flow duct 26 leading to the large flow passage of the turbine of the exhaust-driven turbocharger than in the exhaust gas flow duct 27 leading to the small flow passage of the turbine of the exhaust-driven turbocharger.

Figure 5:
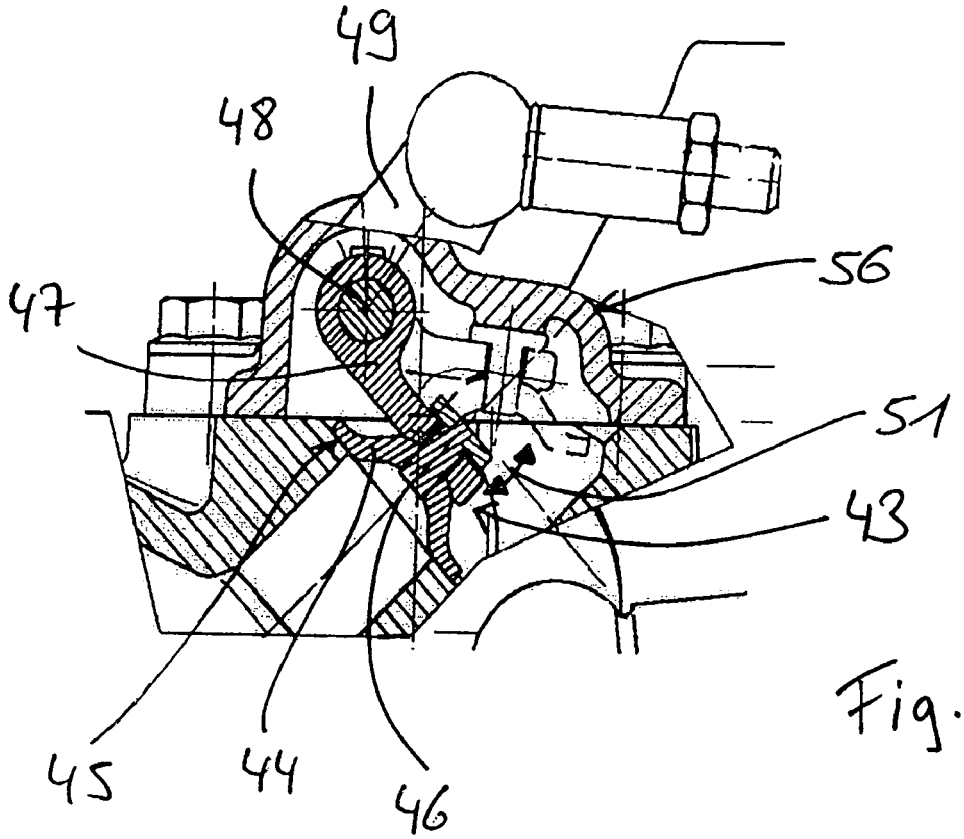
FIG. 5. shows a detail of the central part identified by a circle V in FIG. 3.

The control element 30, embodied as a flap valve, for influencing the engine brake function is preferably eccentrically supported on an operating shaft 33, an operating means 34 in the form of an operating cylinder acting on the operating shaft 33 by way of an operating lever 35 (FIG. 5). The operating cylinder is, in particular, a pneumatic cylinder or a hydraulic cylinder. An electric motor may alternatively be provided as operating means 34.

The operating lever 35, supported and torsionally secured on the operating shaft 33, can be pivoted by the operating means 34, in order thereby to shift the control element 30, embodied as a flap valve, between the switching positions shown in FIG. 3. The eccentric support for the flap valve on the operating shaft 33 makes it possible to minimize the overall space needed for the valve.

Figure 4:
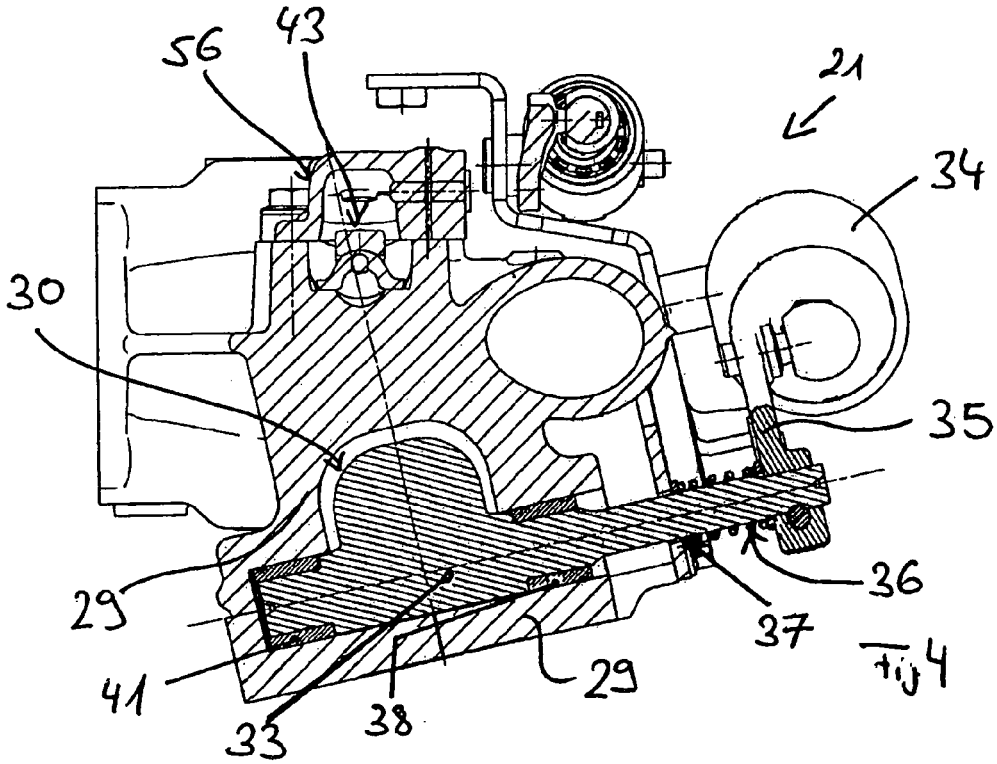
FIG. 4. shows a second cross section through the central part viewed in the direction of the arrows IV-IV according to FIG. 3.

In FIG. 4 a spring element 36 is braced on the one hand against the operating lever 35 and on the other against an outer wall 37 of the central part 21 and in this way draws the operating shaft 33 towards a bearing 38 of the operating shaft 33. This provides for exhaust gas sealing of the control element 30 in the area of the bearing 38 and prevents leakage of exhaust gas from the exhaust gas flow ducts 26, 27. No exhaust gas sealing of the operating shaft 33 is necessary in the area of a second bearing 41, since the second bearing 41 is arranged in a blind hole.

In the first exemplary embodiment as shown in FIGS. 1 to 7 the central part 21 of the exhaust manifold 20 comprises two sections, that is a manifold section 39 and a bearing cover section 40. The control element 30 is supported in a dividing plane between the manifold section 39 and the bearing cover section 40, the manifold section 39 and the bearing cover section 40 being dowelled together. The bearings 38, 41 are fixed in an axial direction by locating pins 42. Centering between the manifold section 39 and the bearing cover section 40 is achieved over the diameter of the two bearings 38, 41 in an easy press fit and by way of the locating pins 42.

As can be seen from FIG. 3, the bearing cover section 40 provides a sealing face, on which the control element 30 embodied as a flap valve rests in the second switching position. A sealing face for the first switching position of the control element 30 is recessed into the wall 29 of the manifold section 39.

Figure 6:
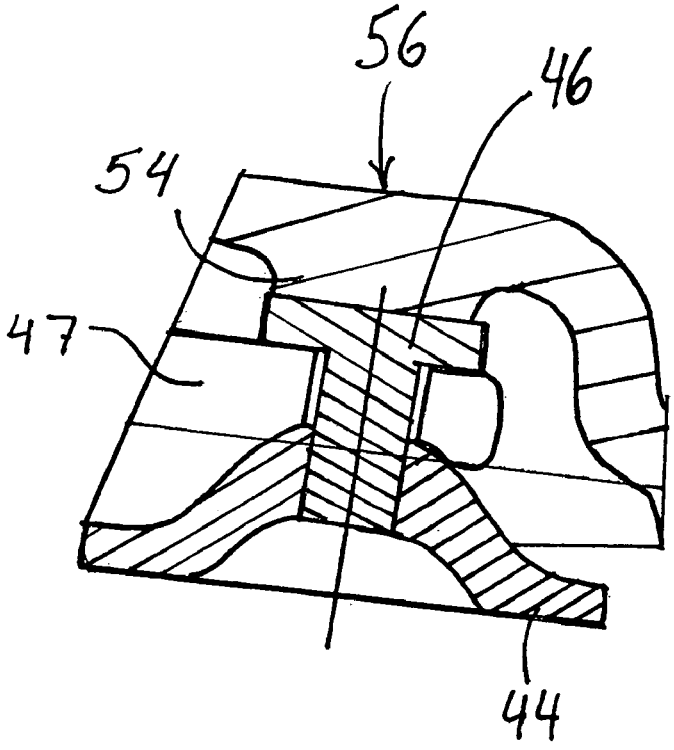
FIG. 6. shows a further enlarged representation of the detail in FIG. 5.

According to a further aspect of the present invention, in addition to the control element 30 for influencing the engine brake function, a control element 43 for influencing an exhaust gas pressure is incorporated into the central part 21 of the exhaust manifold 20 of the exemplary embodiment in FIGS. 1 to 7, upstream of the control element 30 for influencing the engine brake function. The control element 43 for influencing the exhaust gas pressure is embodied as a valve, which in a first switching position shown in FIG. 3 separates the two exhaust gas flow ducts 26, 27 from one another and at the same time controls an exhaust gas flow between the ducts 26, 27. The first switching position is represented by hatching in FIG. 5. In a second switching position of the control element 43, which is shown in FIGS. 5 and 6, the control element 43 is open providing for interconnection between the two exhaust gas flow ducts 26, 27 of the central part 21, the two exhaust gas flow ducts 26, 27 being open to a through-flow in this second switching position.

According to FIGS. 3 to 6 the control element 43 is a disk valve which comprises a valve disk 44, a fixing pin 46 and a carrier element 47. The valve disk 44 is fixed to the carrier element 47 by the fixing pin 46. The fixing pin 46 is preferably guided with some play in the carrier element 47, allowing a slight relative movement between the valve disk 44 and the carrier element 47. In the first switching position the valve disk 44 is in contact with the valve seat 45 in the manifold section 39. In the second switching position the fixing pin 46 bears on a stop 54 in a cover 56 of the central part. The valve disk 44 is spheroidally or spherically contoured on a surface 55, in order to allow compensation for tolerances between the valve disk 44 and the valve seat 45.

The carrier element 47 is torsionally fixed to an operating shaft 48, on which an operating means 50, preferably a pneumatic or hydraulic operating cylinder, acts by way of an operating lever 49. The operating means 50 allows the operating lever 49, the operating shaft 48, the carrier element 47 and hence ultimately the valve disk 44 to be pivoted in the direction of the double arrow 51 represented in FIG. 5 for movement between the two switching positions. It is here preferably also possible to set intermediate positions between the first and the second switching positions.

Figure 7:
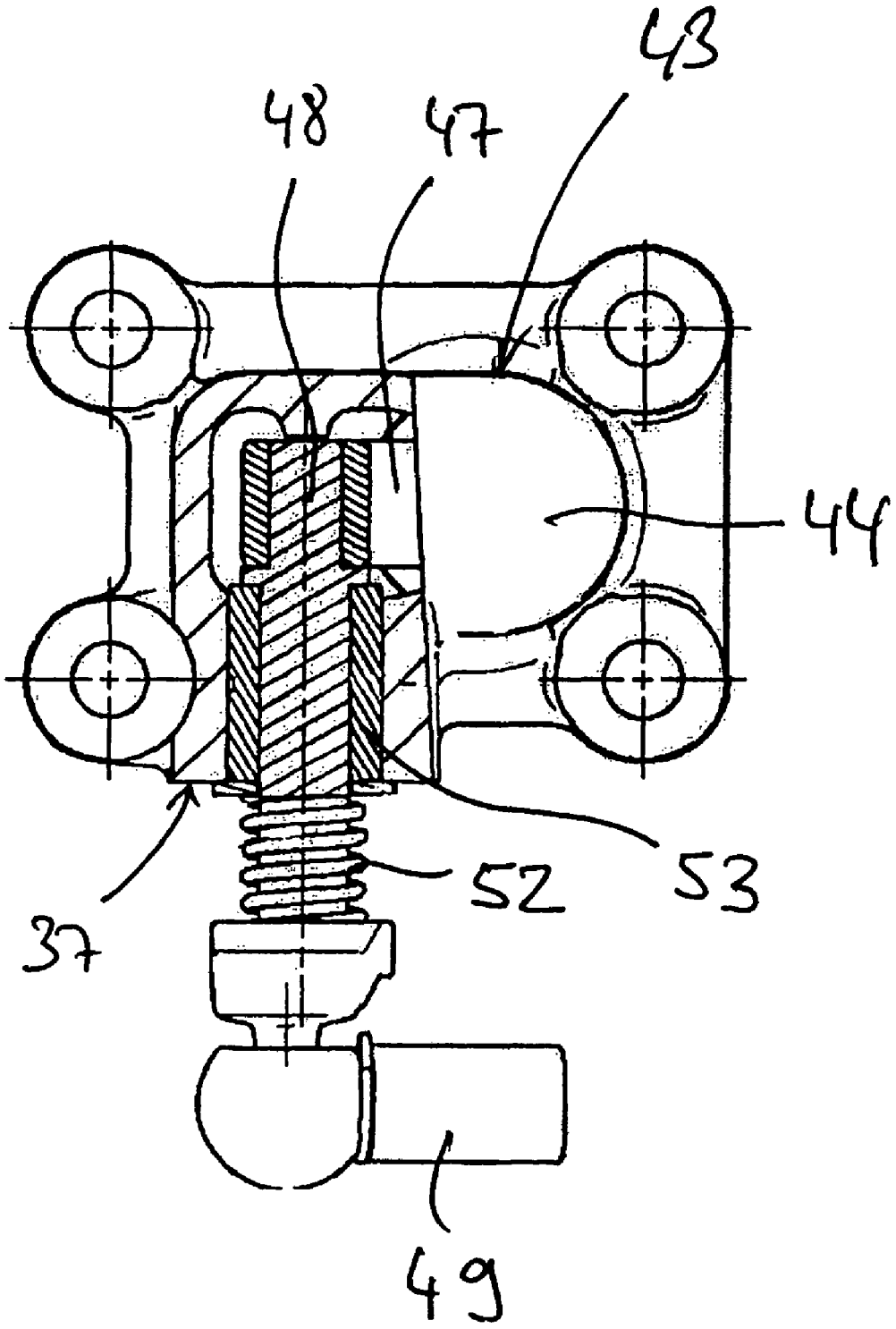
FIG. 7. shows the detail in FIG. 5 viewed in another direction.
Figure 8:
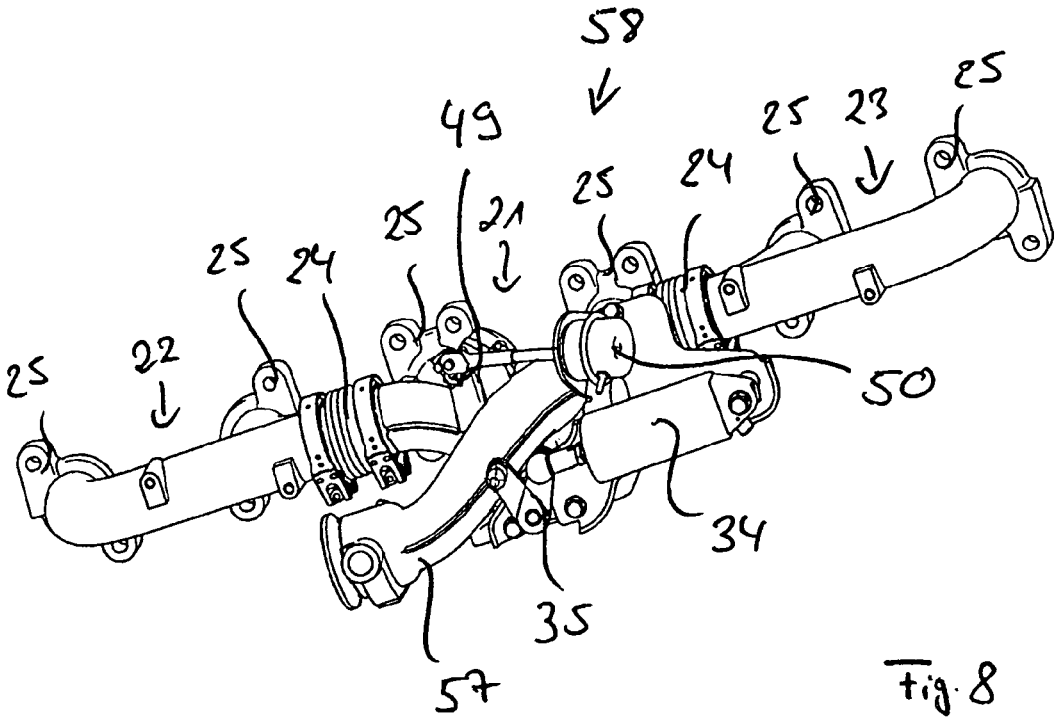
FIG. 8. shows a perspective view of a second exemplary embodiment of an exhaust manifold according to the invention.
Figure 9:
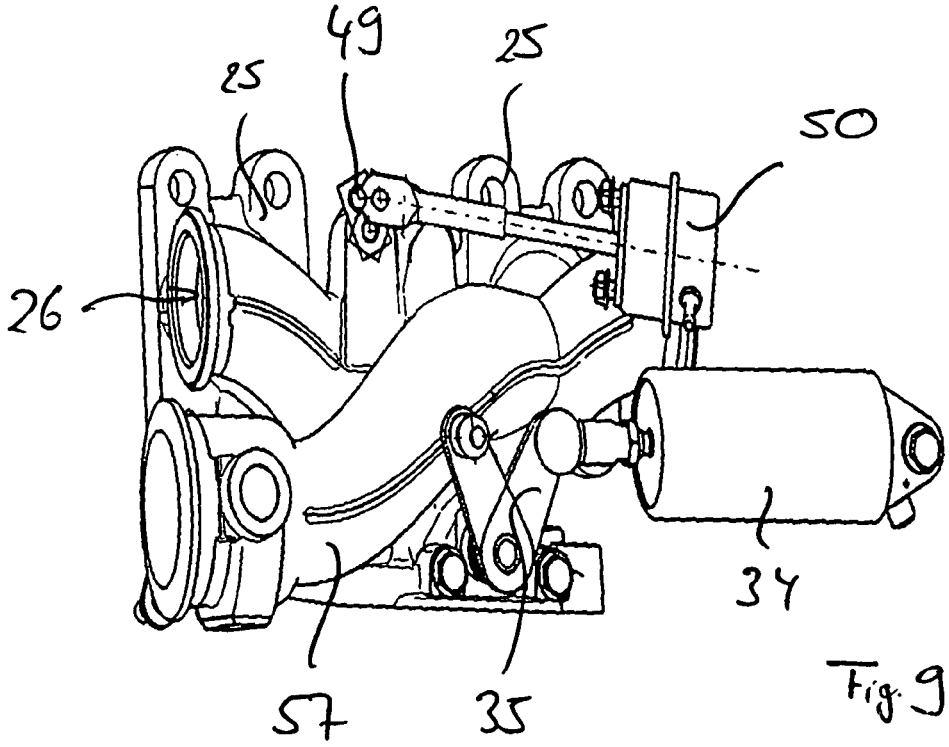
FIG. 9. shows a perspective view of a central part of the exhaust manifold according to FIG. 8.

According to FIG. 7 a spring element 52, is braced against the operating lever 49 on the one hand and against the outer wall 37 of the central part 21 on the other, thereby drawing the operating shaft 48 towards a bearing 53, acts on the operating shaft 48 for the control element 43.

In the exemplary embodiment described with reference to FIGS. 1 to 7, the exhaust manifold 20 according to the invention has an exhaust gas recirculation connection 57 (FIG. 1 and FIG. 2), to which an exhaust gas recirculation line can be connected. The exhaust gas recirculation line allows a partial exhaust gas flow from the exhaust manifold to be returned into an intake system of the internal combustion engine. A further control element, that is a control element for influencing an exhaust gas recirculation rate, is preferably incorporated into this exhaust gas recirculation connection 57. The control element for influencing the exhaust gas recirculation rate is not shown in FIGS. 1 to 7, but will be described with reference to a second exemplary embodiment of an exhaust manifold according to the invention represented in FIGS. 8 to 15. For details of the control element for influencing the exhaust gas recirculation rate in the exemplary embodiment of FIGS. 1 to 7 reference should therefore be made to the exemplary embodiment of FIGS. 8 to 15.

As shown in FIGS. 8 to 15, the exhaust manifold 58 comprises a central part 21 having an exhaust gas recirculation connection 57. A control element 59 for influencing the exhaust gas recirculation rate, which is preferably embodied as a flap valve, is incorporated into the exhaust gas recirculation connection 57. The control element 59 for influencing the exhaust gas recirculation rate is supported on an operating shaft 60, on which an operating means (not shown) acts by way of an operating lever 61.

The operating shaft 60 and hence the control element 59 in the form of a flap valve can be turned by pivoting the operating lever 61, making it ultimately possible to adjust a volumetric flow of the recirculated exhaust gas through the exhaust gas recirculation connection 59.

A spring element 62, which is braced against the operating lever 61 on the one hand and against an outer wall of the exhaust gas recirculation connection 57 on the other, acts on the operating shaft 60 for the control element 59 for influencing the exhaust gas recirculation rate. The operating shaft 60 is thereby drawn towards a bearing 63 and brings about exhaust gas sealing in the area of the bearing 63.

The control element 59 embodied as a flap valve for influencing the exhaust gas recirculation rate is preferably of symmetrical and flow-optimized design with bevel-ground surface, so that with the control element 59 for influencing the exhaust gas recirculation rate in a closed position a precise sealing is ensured and the exhaust gas recirculation flow is at least largely uninterrupted.

A control element for influencing the engine brake function and a control element for influencing the exhaust gas pressure are also incorporated into the central part 21 of the exhaust manifold 58 in the exemplary embodiment in FIGS. 8 to 15, the exemplary embodiment in FIGS. 8 to 15 corresponding in all fundamental details of these control means with the exemplary embodiment in FIGS. 1 to 7. In order to avoid unnecessary repetition, the same reference numerals will be used for the same sub-assemblies in both exemplary embodiments. For the exemplary embodiment shown in FIGS. 8 to 15, below only those details of the two control elements are described where a difference exists compared to the exemplary embodiment in FIGS. 1 to 7. For all other details reference will be made to the descriptions of the exemplary embodiment in FIGS. 1 to 7.

Figure 10:
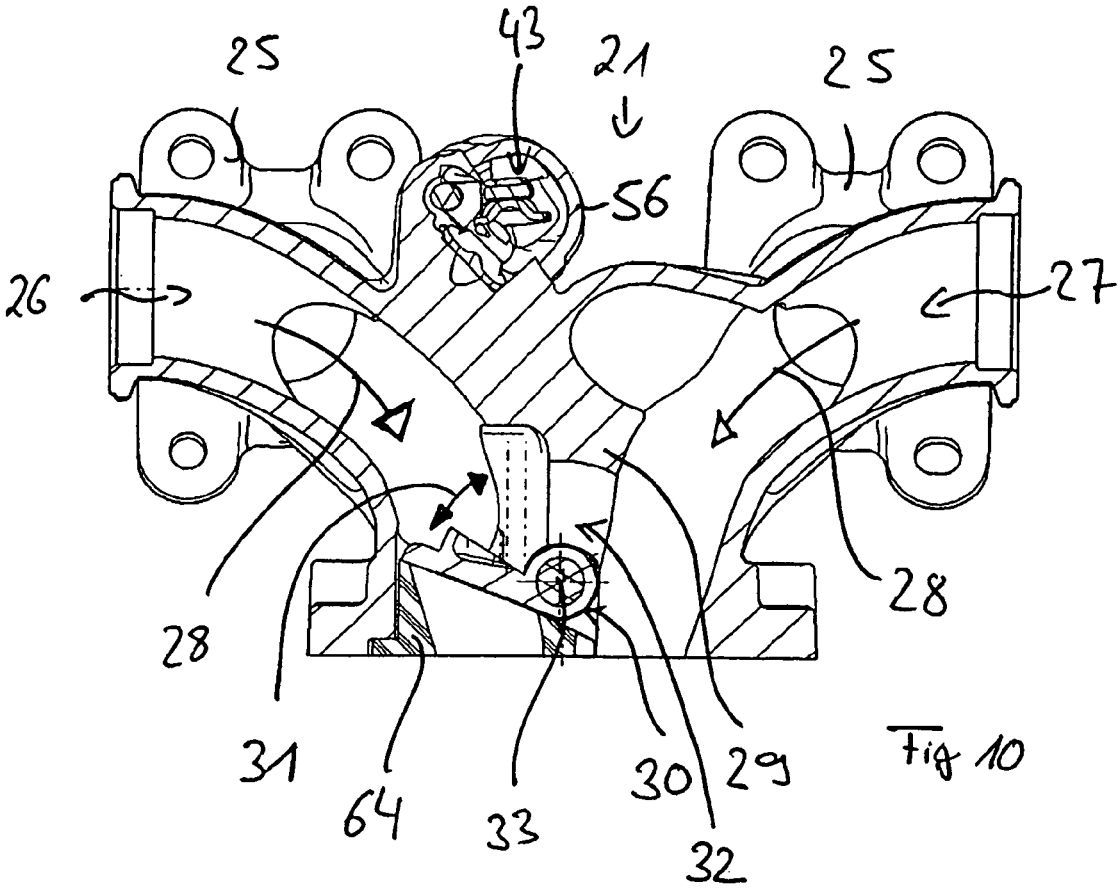
FIG. 10. shows a first cross section through the central part viewed in the direction of the arrows X-X according to FIG. 9.
Figure 11:
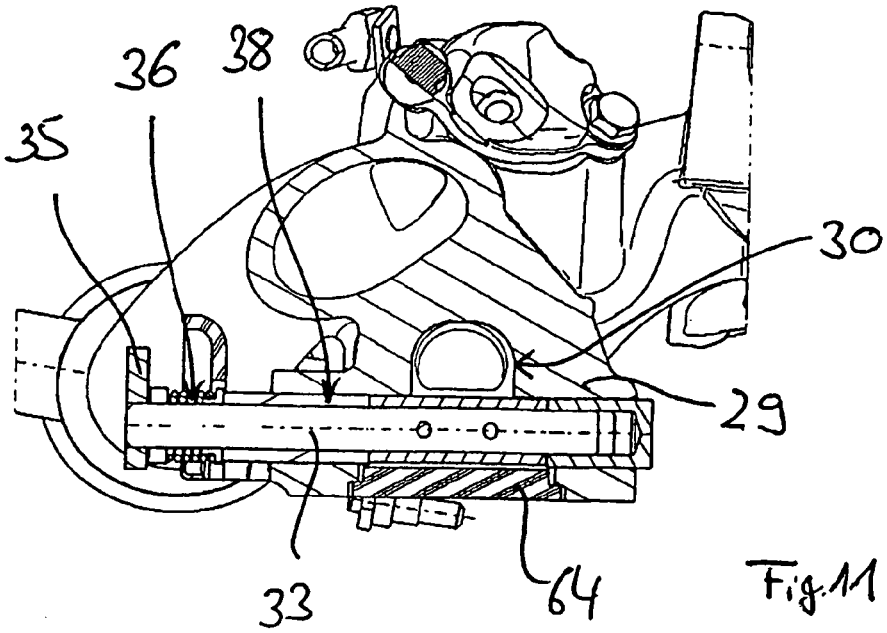
FIG. 11. shows a second cross section through the central part viewed in the direction of the arrows XI-XI according to FIG. 10.

A first difference between the exemplary embodiment in FIGS. 8 to 15 and the exemplary embodiment in FIGS. 1 to 7 is that, in the exemplary embodiment in FIGS. 8 to 15, the central part 21 of the exhaust manifold according to the invention is integrally formed instead of being formed in two parts. The sealing face for sealing off the control element 30 for influencing the engine brake function in the second switching position is formed by an insert 64, which according to FIG. 10 is inserted into the central part 21, that is into an exhaust gas flow duct 26 thereof. The insert 64 is supported by a three-point support in the central part 21 of the exhaust manifold 58 and facilitates fitting of the control element 30.

This means that in contrast to the exemplary embodiment in FIGS. 1 to 7 there is no need for alignment and centering of the manifold section and of the bearing cover section relative to one another, thereby reducing the number of external sealing points.

Figure 12:
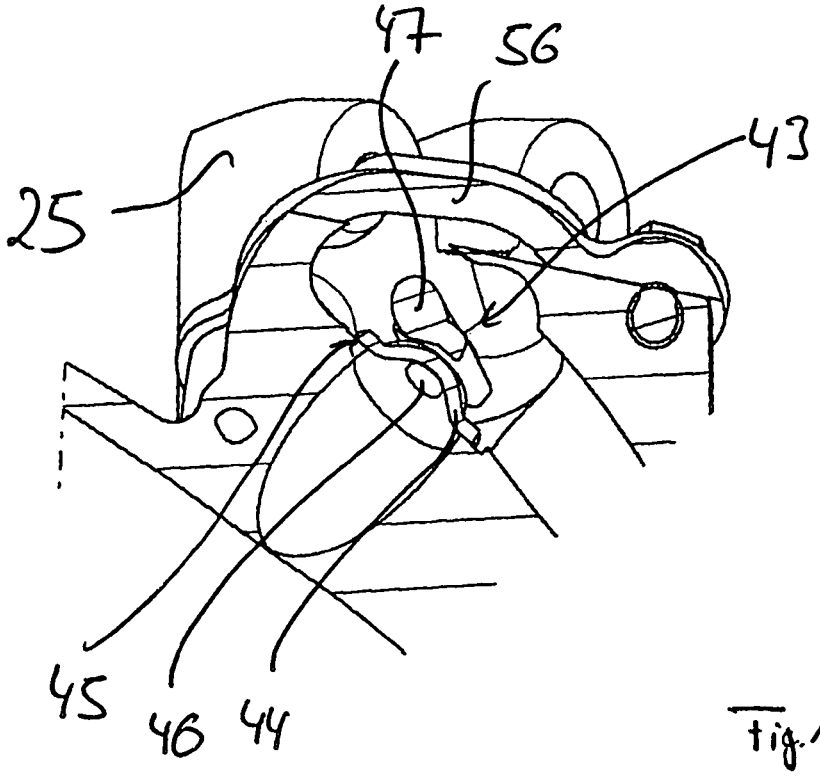
FIG. 12. shows an enlarged representation of a detail of the central part according to FIG. 9.

Another difference of the exhaust manifold 58 in the exemplary embodiment in FIGS. 8 to 15 compared to the exhaust manifold 20 in the exemplary embodiment in FIGS. 1 to 7 is that in the exemplary embodiment in FIGS. 8 to 15 the control element 43 for influencing the exhaust gas pressure is incorporated directly into the central part 21 of the exhaust manifold 58 and not into a cover 56, as in the exemplary embodiment in FIGS. 1 to 7. The control element 43 is again embodied as a disk valve and comprises a valve disk 44 and a valve seat 45, the valve disk 44 being supported via a fixing pin 46 on a carrier element 47 (FIG. 12).

Figure 13:
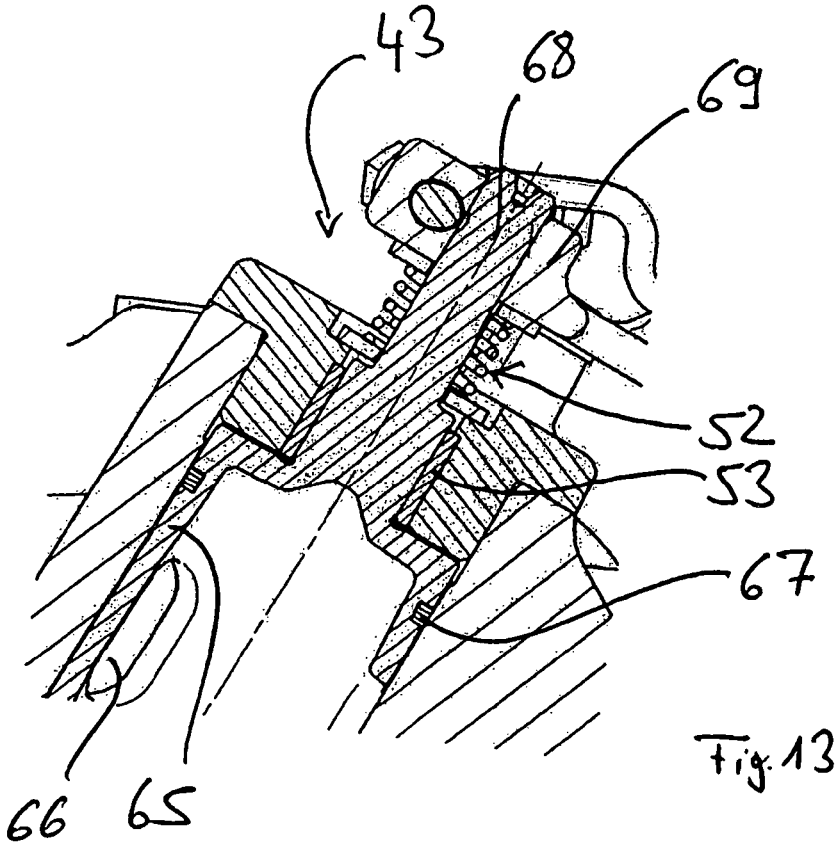
FIG. 13. shows another embodiment of the detail.
Figure 14:
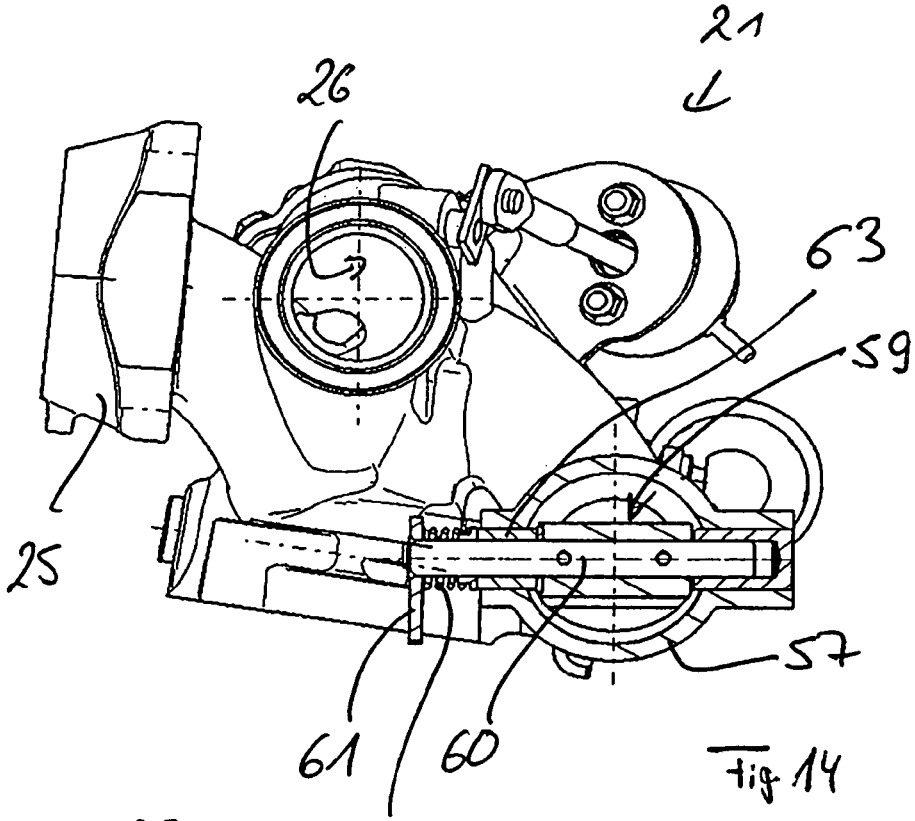
FIG. 14. shows a further perspective view of the central part according to FIG. 9 with an exhaust gas recirculation connection partially cut away.
Figure 15:
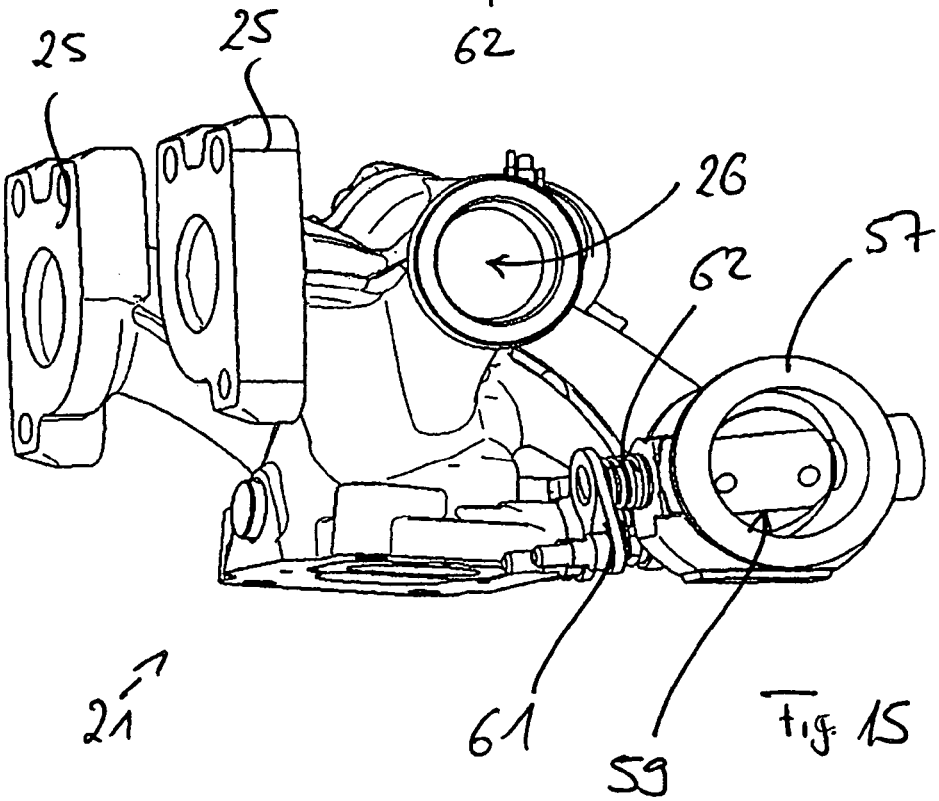
FIG. 15. shows a further perspective view of the central part according to FIG. 9.

FIG. 13 shows an alternative embodiment of the control element 43 for influencing the exhaust gas pressure, in which the control element 43 is embodied as a rotary slide valve. According to FIG. 13 a rotary slide valve 65 with an eccentric transverse bore 66 is disposed in a duct in the central part 21, the transverse slide 66 being radially sealed off from the outside by a sealing ring 67. The rotary slide valve 65 is supported on an operating shaft 68, on which the operating means 34 can act by way of an operating lever 69. A spring element 52, which acts on the operating shaft 68 and as in FIG. 7 draws the control element 43 towards a bearing 53, serves for further exhaust gas sealing of the rotary slide valve 65.

What is claimed is:

1. An exhaust manifold for an internal combustion engine having first and second cylinder groups, said exhaust manifold (20) comprising a central part (21) and two exhaust gas flow ducts (26, 27) connected to the central part (21) for delivering engine exhaust gas from the first cylinder group of the internal combustion engine via the first exhaust gas flow duct (26) to the central part (21) and engine exhaust gas from the second cylinder group of the internal combustion engine via the a second exhaust gas flow duct (27) to the central part (21) and supplying the exhaust gas to a first turbine inlet flow passage via the first exhaust gas flow duct (26) and to a second turbine inlet flow passage via the second exhaust gas flow duct (27), and a motor brake control element (30) for influencing an engine brake function, a pressure control element (43) for influencing an exhaust gas pressure upstream of the motor brake control element (30) and a recirculation control element (59) for controlling an exhaust gas recirculation rate, wherein the motor brake control element (30), the pressure control element (43), and the recirculation control element (59) are incorporated into the central part (21) of the manifold (20), wherein said motor brake control element (30) for controlling the brake function is incorporated into a wall (29) of the central part (21) and has a first switching position in which said motor brake control element (30) separates the two exhaust gas flow ducts (26, 27) from one another, and a second switching position in which the two exhaust gas flow ducts (26, 27) are joined together for directing the exhaust gas flows of both exhaust gas flow ducts (26, 27) to only one of the turbine inlet flow passages.

2. The exhaust manifold as claimed in claim 1, wherein the motor brake control element (30) for influencing the engine brake function is a flap valve, which, in a first switching position, whilst the internal combustion engine is operated under power, closes an opening (32) in the wall (29) of the central part (21), thereby separating the two exhaust gas flow ducts (26, 27) from one another, and which, in a second switching position, during an engine braking mode of the internal combustion engine, opens the opening (32) in the wall (29) of the central part (21), thereby connecting the two exhaust gas flow ducts (26, 27) together, and at least partially closing one of the two exhaust gas flow ducts (26).

3. The exhaust manifold as claimed in claim 2, wherein the flap valve (30) has two effective areas of different sizes.

4. The exhaust manifold as claimed in claim 1, wherein the motor brake control element (30) for influencing the engine brake function is eccentrically supported on an operating shaft (33), and an operating means (34) acts on the operating shaft (33) in order to operate the motor brake control element (30).

5. The exhaust manifold as claimed in claim 4, wherein a spring element (36), is arranged between an outer wall of the central part and the operating shaft whereby the operating shaft (33) is drawn towards a bearing (38).

6. The exhaust manifold as claimed in claim 1, wherein the pressure control element (43) for influencing the exhaust gas pressure upstream of the motor brake control element (30) is supported by an operating shaft (48), an operating means (51) being connected to the operating shaft (48) in order to operate the pressure control element (43).

7. The exhaust manifold as claimed in claim 6, wherein a spring element (52), is provided and is braced against an outer wall of the central part and the operating shaft (48) and for drawing the operating shaft (48) towards a bearing (53).

8. The exhaust manifold as claimed in claim 1, wherein the control element (59) for controlling the exhaust gas recirculation rate is incorporated into an exhaust gas recirculation connection (57) of the central part (21).

9. The exhaust manifold as claimed in claim 8, wherein the control element (59) for controlling the exhaust gas recirculation rate is a flap valve, the position of which determines a volumetric flow of the recirculated exhaust gas through the exhaust gas recirculation connection (57).

10. The exhaust manifold as claimed in claim 8, wherein the control element (59) for controlling the exhaust gas recirculation rate is supported on an operating shaft (60), an operating means being connected to the operating shaft (60) for operating the control element (59).

11. The exhaust manifold as claimed in claim 10, wherein a spring element (62), is arranged between an outer wall of the central part and the operating shaft (60), for drawing the operating shaft (60) towards a bearing (63).

* * * * *